US010007215B2

(12) United States Patent
Yamamoto et al.

(10) Patent No.: US 10,007,215 B2
(45) Date of Patent: Jun. 26, 2018

(54) FIXING DEVICE AND IMAGE FORMING DEVICE FOR PERFORMING PRELIMINARY CONTROL OF FIXING UNIT HEATER

(71) Applicant: Konica Minolta, Inc., Tokyo (JP)

(72) Inventors: Kenji Yamamoto, Hachioji (JP); Kenji Tamaki, Tokorozawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days. days.

(21) Appl. No.: 15/171,683

(22) Filed: Jun. 2, 2016

(65) Prior Publication Data

US 2016/0357135 A1 Dec. 8, 2016

(30) Foreign Application Priority Data

Jun. 8, 2015 (JP) ..... 2015-115414

(51) Int. Cl.
*G03G 15/20* (2006.01)

(52) U.S. Cl.
CPC ..... *G03G 15/2039* (2013.01); *G03G 15/2032* (2013.01); *G03G 15/2053* (2013.01)

(58) Field of Classification Search
None
See application file for complete search history.

(56) References Cited

U.S. PATENT DOCUMENTS 5,789,723 A * 8/1998 Hirst ..... G03G 15/80 219/216
2011/0064444 A1* 3/2011 Adachi ..... G03G 15/80 399/69
2011/0217062 A1* 9/2011 Chosokabe ..... G03G 15/80 399/69

(Continued)

FOREIGN PATENT DOCUMENTS

JP H09-258598 A 10/1997
JP 11212386 A * 8/1999
JP 2001-343858 A 12/2001

(Continued)

OTHER PUBLICATIONS

JP_11212386_A_T MachineTranslation, Japan, Inomata, 1999.*

(Continued)

*Primary Examiner* — Victor Verbitsky
(74) *Attorney, Agent, or Firm* — Buchanan Ingersoll & Rooney PC

(57) ABSTRACT

A fixing device includes: a fixing unit which heats a recording medium to fix a color material adhered to the recording medium; a first heater which heats the fixing unit; a second heater with rated power smaller than the rated power of the first heater which heats the fixing unit; and a controller which performs preliminary control of energizing the second heater when heating of the fixing unit by the first heater is started and energizing control of stepping up power consumption of the first heater and stepping down the power consumption of the second heater such that a change amount (Continued)

when a sum of the power consumption of the first heater and the power consumption of the second heater changes becomes a value to make a flicker value indicating a degree of a flicker not larger than a predetermined standard value after executing the preliminary control.

14 Claims, 12 Drawing Sheets

(56) References Cited

U.S. PATENT DOCUMENTS

2016/0327898 A1* 11/2016 Fujiwara ..... G03G 15/80

FOREIGN PATENT DOCUMENTS

| | | | | |
|---|---|---|---|---|
| JP | 2001-356635 | A | | 12/2001 |
| JP | 2001343858 | A | * | 12/2001 |
| JP | 2010-186218 | A | | 8/2010 |

OTHER PUBLICATIONS

JP_2001343858_A_T MachineTranslation, Japan, Masushiro, 2001.*

Office Action (Notice of Reasons for Rejection) dated May 30, 2017, by the Japanese Patent Office in corresponding Japanese Patent Application No. 2015-115414, and an English translation of the Office Action. (12 pages).

* cited by examiner

FIXING DEVICE AND IMAGE FORMING DEVICE FOR PERFORMING PRELIMINARY CONTROL OF FIXING UNIT HEATER

The entire disclosure of Japanese Patent Application No. 2015-115414 filed on Jun. 8, 2015 including description, claims, drawings, and abstract are incorporated herein by reference in its entirety.

BACKGROUND OF THE INVENTION

Field of the Invention

The present invention relates to a fixing device and an image forming device.

Description of the Related Art

An image forming device provided with an image forming unit which allows toner to adhere to paper to form an image and an image fixing unit which heats and pressurizes the paper to which the toner is adhered to fix the toner on the paper is conventionally known. There is the image fixing unit which heats and pressurizes the paper by means of a nip portion of a roller pair including a heating roller in which a heater is embedded and that which heats and pressurizes the paper through a fixing belt stretched on the above-described heating roller.

A heater capable of generating large inrush current such as a halogen heater is generally used as the heater of the heating roller. Therefore, a flicker beyond a predetermined standard value might occur due to fluctuation in power supply voltage caused by the inrush current when the power consumption drastically changes such as when energization of the heater is started in the above-described image forming device. In view of this, JP 2001-343858 A discloses the technology of inhibiting the occurrence of the flicker by decreasing a change amount when the power consumption of the heater changes by performing half-wave control of stepping up a duty ratio of a period in which the heater is energized in units of half cycle of a voltage waveform of an AC power supply.

However, when rated power of the heater is large, the change amount when the power consumption changes does not become sufficiently small by control of an energizing period in units of half cycle of the voltage waveform of the AC power supply and the flicker beyond the standard value problematically occurs.

When the power consumption of the heater is slightly stepped up by phase control in place of the half-wave control in order to inhibit the flicker, there is a problem that it takes time for the heating roller (fixing unit) to be heated to desired temperature.

SUMMARY OF THE INVENTION

An object of the present invention is to provide the fixing device and the image forming device capable of rapidly increasing or decreasing the temperature of the fixing unit while inhibiting the occurrence of the flicker beyond the standard value regardless of the rated power of the heater.

To achieve the abovementioned object, according to an aspect, a fixing device reflecting one aspect of the present invention comprises: a fixing unit which heats a recording medium to fix a color material adhered to the recording medium; a first heater which heats the fixing unit; a second heater with rated power smaller than the rated power of the first heater which heats the fixing unit; and a controller which performs preliminary control of energizing the second heater when heating of the fixing unit by the first heater is started and energizing control of stepping up power consumption of the first heater and stepping down the power consumption of the second heater such that a change amount when a sum of the power consumption of the first heater and the power consumption of the second heater changes becomes a value to make a flicker value indicating a degree of a flicker not larger than a predetermined standard value after executing the preliminary control.

According to an invention of Item. 2, in the fixing device of Item. 1, the controller preferably steps up the power consumption of the second heater such that the change amount when the power consumption of the second heater changes becomes the value to make the flicker value indicating the degree of the flicker not larger than a predetermined standard value in the preliminary control.

To achieve the abovementioned object, according to an aspect, a fixing device reflecting one aspect of the present invention comprises: a fixing unit which heats a recording medium to fix a color material adhered to the recording medium; a first heater which heats the fixing unit; a second heater with rated power smaller than the rated power of the first heater which heats the fixing unit; and a controller which performs energizing control of stepping down power consumption of the first heater and stepping up the power consumption of the second heater such that a change amount when a sum of the power consumption of the first heater and the power consumption of the second heater changes becomes a value to make a flicker value indicating a degree of a flicker not larger than a predetermined standard value when heating of the fixing unit by the first heater is finished.

According to an invention of Item. 4, in the fixing device of Item. 3, the controller preferably steps down the power consumption of the second heater such that the change amount when the power consumption of the second heater changes becomes the value to make the flicker value indicating the degree of the flicker not larger than a predetermined standard value after performing the energizing control.

According to an invention of Item. 5, in the fixing device of any one of Items. 1 to 4, the controller preferably changes a duty ratio of a period in which a voltage waveform is applied to each of the first and second heaters in units of half cycle of the voltage waveform of an AC power supply in the energizing control.

According to an invention of Item. 6, in the fixing device of any one of Items. 1 to 4, the controller preferably changes a duty ratio of a period in which a voltage waveform is applied to each of the first and second heaters by changing a ratio of an applying period of the voltage waveform in each half cycle of the voltage waveform of an AC power supply in the energizing control.

According to an invention of Item. 7, in the fixing device of any one of Items. 1 to 6, the flicker value is preferably a short-time flicker value and the standard value is one.

According to an invention of Item. 8, in the fixing device of any one of Items. 1 to 6, the flicker value is preferably a long-time flicker value and the standard value is 0.65.

According to an invention of Item. 9, in the fixing device of any one of Items. 1 to 8, the first heater is preferably a halogen heater.

To achieve the abovementioned object, according to an aspect, an image forming device reflecting one aspect of the present invention comprises: an image forming unit which allows a color material to adhere to a recording medium to record an image; and the fixing device of any one of Items. 1 to 9.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment according to a fixing device and an image forming device of the present invention will be described with reference to the drawings. However, the scope of the invention is not limited to the illustrated examples.

Figure 1:
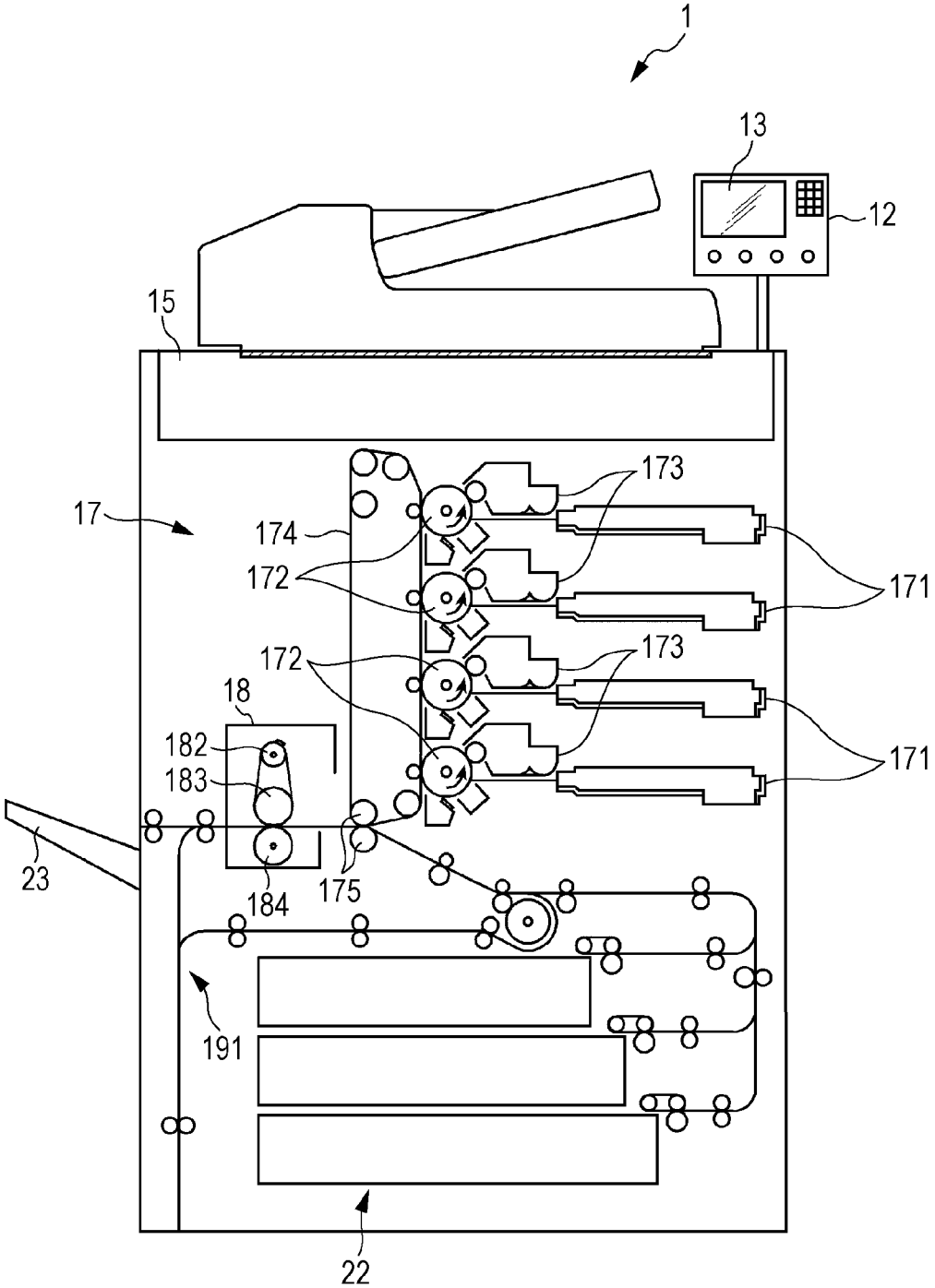
FIG. 1 is a view illustrating a schematic configuration of an image forming system.

FIG. 1 is a view illustrating a schematic configuration of an image forming device 1 being an embodiment of the present invention.

Figure 2:
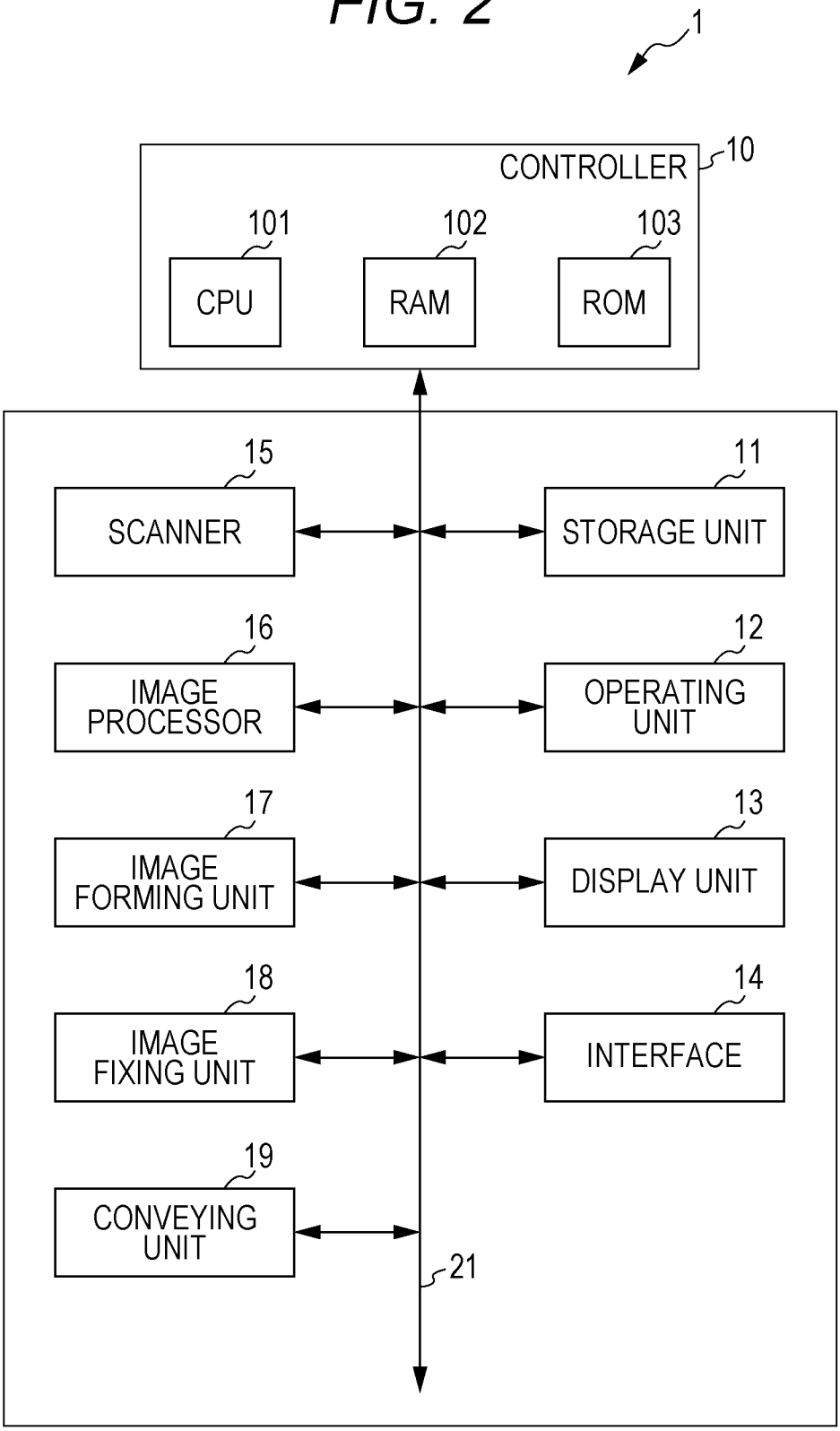
FIG. 2 is a block diagram illustrating a principal functional configuration of an image forming device.

FIG. 2 is a block diagram illustrating a principal functional configuration of the image forming device 1.

The image forming device 1 is provided with a controller 10 including a CPU (central processing unit) 101, a RAM (random access memory) 102, and a ROM (read only memory) 103, a storage unit 11, an operating unit 12, a display unit 13, an interface 14, a scanner 15, an image processor 16, an image forming unit 17, an image fixing unit 18, a conveying unit 19 and the like. The controller 10 is connected to the storage unit 11, the operating unit 12, the display unit 13, the interface 14, the scanner 15, the image processor 16, the image forming unit 17, the image fixing unit 18, and the conveying unit 19 through a bus 21.

The CPU 101 reads a control program stored in the ROM 103 or the storage unit 11 to execute and performs various types of arithmetic processing.

The RAM 102 provides a working memory space to the CPU 101 to store temporary data.

The ROM 103 stores the various control programs executed by the CPU 101, setting data and the like. Meanwhile, a rewritable non-volatile memory such as an EEPROM (electrically erasable programmable read only memory) and a flash memory may also be used in place of the ROM 103.

The controller 10 provided with the CPU 101, the RAM 102, and the ROM 103 comprehensively controls each unit of the image forming device 1 according to the above-described various control programs. For example, the controller 10 allows the image processor 16 to perform predetermined image processing on image data and store the data in the storage unit 11. The controller 10 allows the conveying unit 19 to convey paper (recording medium) and allows the image forming unit 17 to form an image on the paper based on the image data stored in the storage unit 11.

The storage unit 11 formed of a DRAM (dynamic random access memory) and the like stores the image data obtained by the scanner 15, the image data externally input through the interface 14 and the like. Meanwhile, the image data and the like may also be stored in the RAM 102.

The operating unit 12 provided with an input device such as an operation key and a touch panel arranged so as to be overlapped with a screen of the display unit 13 converts input operation to the input device to an operation signal to output to the controller 10.

The display unit 13 provided with a display device such as an LCD (liquid crystal display) displays an operation screen displaying a state of the image forming system 1 and contents of the input operation to the touch panel and the like.

The interface 14 being a unit which transmits/receives the data to/from a paper feeder 2, a post processing device 4, an external computer, another image forming device and the like is formed of any one of various serial interfaces, for example.

The scanner 15 reads the image formed on the paper and generates the image data including single color image data for respective color components of R (red), G (green), and B (blue) to store in the storage unit 11.

The image processor 16 provided with a rasterizing processor, a color converter, a gradation corrector, and a halftone processor, for example, performs various types of image processing on the image data stored in the storage unit 11 to store in the storage unit 11.

The image forming unit 17 forms the image on the paper based on the image data stored in the storage unit 11. The image forming unit 17 is provided with four groups of exposure units 171, photoreceptors 172, and developing units 173 corresponding to respective color components of C, M, Y, and K. The image forming unit 17 is also provided with a transfer body 174 and a secondary transfer roller 175.

The exposure unit 171 is provided with an LD (laser diode) as a light emitting element. The exposure unit 171 drives the LD based on the image data, thereby irradiating the charged photoreceptor 172 with laser light to expose, and forms an electrostatic latent image on the photoreceptor 172. The developing unit 173 supplies toner (color material) of a predetermined color (any one of C, M, Y, and K) on the exposed photoreceptor 172 by means of a charged developing roller and develops the electrostatic latent image formed on the photoreceptor 172.

The images (single color images) formed with the toner of C, M, Y, and K on the four photoreceptors 172 corresponding to C, M, Y, and K, respectively, are sequentially transferred from the photoreceptors 172 onto the transfer body 174 in an overlapping manner. According to this, the color image having the color components of C, M, Y, and K is formed on the transfer body 174. The transfer body 174 being an endless belt wound around a plurality of transfer body conveying rollers rotates as the transfer body conveying rollers rotate.

The secondary transfer roller 175 transfers the color image on the transfer body 174 onto the paper fed from the paper feeder 2 or a paper feed tray 22. In detail, predetermined transfer voltage is applied to the secondary transfer rollers 175 holding the paper and the transfer body 174, so that the toner forming the color image on the transfer body 174 is attracted toward the paper to be transferred onto the paper.

The image fixing unit 18 performs a fixing process of fixing the toner on the paper by heating and pressurizing the paper onto which the toner is transferred.

Figure 3:
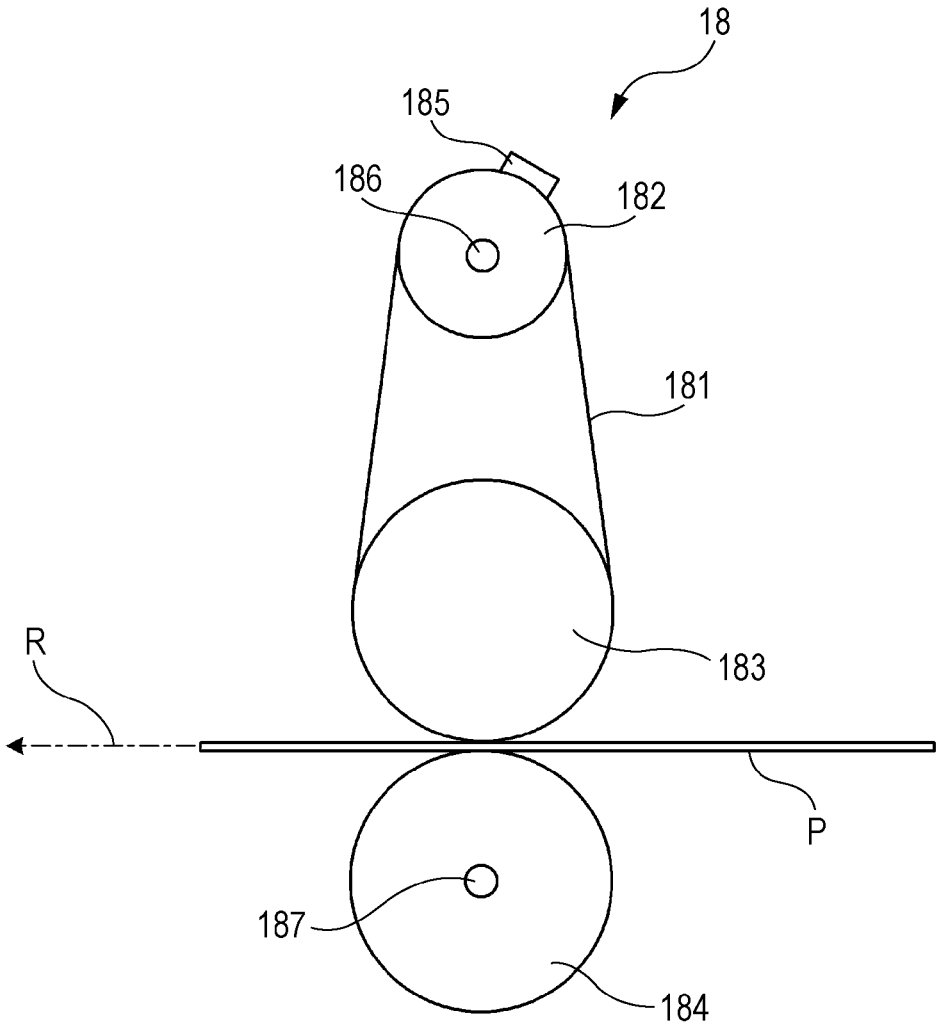
FIG. 3 is a schematic diagram illustrating a configuration of an image fixing unit.

FIG. 3 is a schematic diagram illustrating a configuration of the image fixing unit 18. The image fixing unit 18 is provided with a fixing belt 181, a heating roller 182, an upper pressurizing roller 183, a lower pressurizing roller 184, a temperature sensor 185 and the like. Out of them, the fixing belt 181, the upper pressurizing roller 183, and the lower pressurizing roller 184 form a fixing unit. The image fixing unit 18 and the controller 10 form the fixing device.

The fixing belt 181 is a circular belt stretched around the heating roller 182 and the upper pressurizing roller 183. The heating roller 182 is provided with a first heater 186 extending in a rotary axis direction thereof. The first heater 186 is energized under the control of the controller 10 to generate heat. In this embodiment, a halogen heater with rated power of 1050 W is used as the first heater 186. The heating roller 182 is such that a roller surface heated by the first heater 186 is brought into contact with the fixing belt 181 to heat the fixing belt 181. The heating roller 182 and the upper pressurizing roller 183 are driven by a rotary driving unit such as a motor not illustrated under the control of the controller 10 to rotate, thereby rotating the fixing belt 181. The lower pressurizing roller 184 biased in a direction toward the upper pressurizing roller 183 by an elastic member not illustrated to be press-fitted to the fixing belt 181 rotates as the fixing belt 181 rotates while forming fixing nip between the same and the fixing belt 181. The lower pressurizing roller 184 is provided with a second heater 187 extending in a rotary axis direction thereof and a roller surface of which is heated by the second heater 187. The second heater 187 is energized under the control of the controller 10 to generate heat. In this embodiment, a halogen heater with rated power of 540 W is used as the second heater 187.

The heated fixing belt 181 and lower pressurizing roller 184 heat and pressurize paper P while holding the paper P by the fixing nip and conveying the same in a conveying direction R indicated by arrow in FIG. 3. According to this, the fixing belt 181 and the lower pressurizing roller 184 melt the toner on the recording medium P to fix. Temperature of the fixing belt 181 when this is brought into contact with the paper P is set within a range not lower than 180 degrees C. and not higher than 200 degrees C., for example. Therefore, the heating roller 182 heats the fixing belt 181 such that the temperature of the fixing belt 181 satisfies this condition.

An induction heating heater and a resistance heating element in addition to the halogen heater may also be used as the first and second heaters 186 and 187.

The conveying unit 19 provided with a plurality of paper conveying rollers which conveys the paper by rotating in a state of holding the paper conveys the paper on a predetermined conveyance path. The conveying unit 19 is provided with a reversing mechanism 191 which reverses the paper on which the fixing process is performed by the image fixing unit 18 to convey to the secondary transfer roller 175. In the image forming device 1, the paper is reversed by the reversing mechanism 191 when the image is formed on both sides of the paper, and the paper is discharged to a paper discharge tray 23 after the image is formed on both sides. When the image is formed on a single side of the paper, the paper is not reversed by the reversing mechanism 191 and the paper on the single side of which the image is formed is discharged to the paper discharge tray 23.

Next, operation and a controlling method of the first and second heaters 186 and 187 in the image forming device 1 are described.

Figure 4:
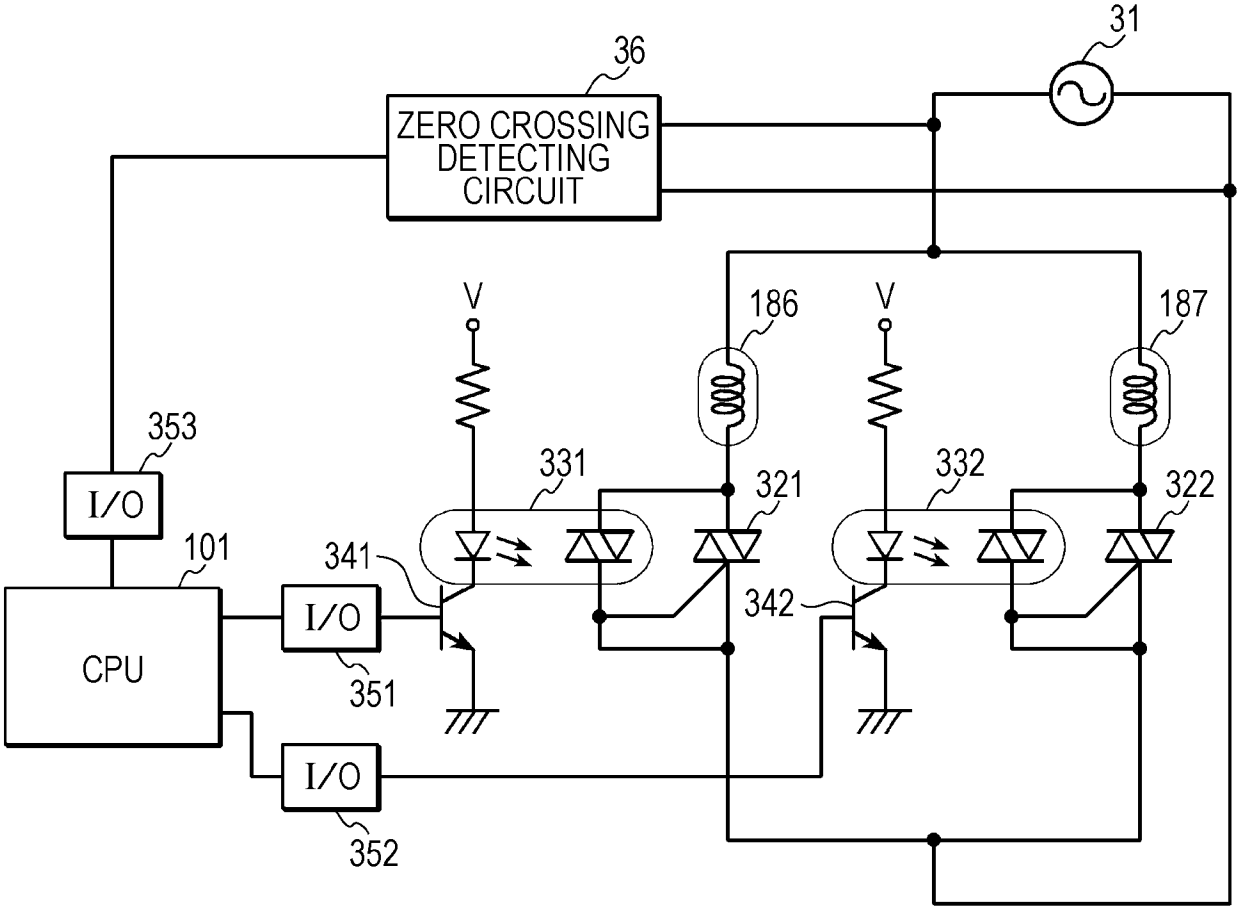
FIG. 4 is a schematic diagram illustrating a configuration of a driving circuit of first and second heaters.

FIG. 4 is a schematic diagram illustrating a configuration of a driving circuit of the first and second heaters 186 and 187.

The driving circuit is provided with the first and second heaters 186 and 187 connected in parallel to a commercial AC power supply 31, triacs 321 and 322 connected in series to the first and second heaters 186 and 187, respectively, photo triac couplers 331 and 332 connected in parallel to the triacs 321 and 322 to apply trigger voltage to gates of the triacs 321 and 322, respectively, transistors 341 and 342 which control energization to light emitting diodes of the photo triac couplers 331 and 332, respectively, and a zero crossing detecting circuit 36 which detects a zero crossing point (point at which a phase is 0 degree or 180 degrees) in a voltage waveform of the AC power supply 31. In such driving circuit, the CPU 101 controls supply power to the first and second heaters 186 and 187, that is to say, power consumption in the first and second heaters 186 and 187 by half-wave control of controlling the energization for each half wave of the voltage waveform of the AC power supply 31. Herein, the half wave is intended to mean the waveform separated at positions at which the phase is 0 degree and 180 degrees having a length of a half cycle of the waveform out of the voltage waveform of the AC power supply 31.

In the control of the supply power to the first heater 186 by the half-wave control, the CPU 101 outputs an on-signal to turn the heater on to a gate of the transistor 341 through an I/O 351 at timing at which the zero crossing point is input from the zero crossing detecting circuit 36 through an I/O 353. The transistor 341 is put into a conductive state when the on-signal is input to the gate thereof, then the current flows to the light emitting diode of the photo triac coupler 331 and the photo triac coupler 331 is tuned on. According to this, trigger voltage is applied to the gate of the triac 321 and the triac 321 is brought into the conductive state, then the current according to the voltage of the AC power supply 31 flows to the first heater 186 until the triac 321 is blocked at a next zero crossing point and the first heater 186 is heated. According to this, the first heater 186 to which the voltage is applied in a period corresponding to one half wave operates. In this manner, the controller 10 including the CPU 101 controls the supply power to the first heater 186 by changing a ratio of the half wave in which the above-described operation is executed out of the half waves included in the voltage waveform of the AC power supply 31.

Meanwhile, although the control regarding the first heater 186 is described above, the control regarding the second heater 187 is similarly performed. That is to say, in the description above, replacing the first heater 186, the triac 321, the photo triac coupler 331, the transistor 341, and the I/O 351 with the second heater 187, the triac 322, the photo triac coupler 332, the transistor 342, and the I/O 352, respectively, makes an aspect of the control regarding the second heater 187.

The CPU 101 may independently control the operation of the first heater 186 and that of the second heater 187 by controlling timing at which the on-signal is output to the transistors 341 and 342.

In the image forming device 1 of this embodiment, predetermined heating starting operation and heating finishing operation to inhibit drastic change in the power consumption are performed when the first heater 186 starts heating and finishes heating in order to inhibit occurrence of a flicker caused by change in the power consumption in the first and second heaters 186 and 187. They are hereinafter described.

Herein, the flicker is intended to mean a phenomenon that the voltage of the AC power supply fluctuates due to inrush current generated in a device connected to the AC power supply, thereby affecting operation of other devices connected to the AC power supply; a representative phenomenon includes flickering of a lighting device.

As an index indicating a degree of the flicker (flicker value), a short-time flicker value (Pst value) and a long-time flicker value (Plt value) defined by IEC (International Electrotechnical Commission) standards (IEC61000-3-3) are known. The Pst value indicates the degree of the flicker measured in 10 minutes. When the Pst value is one, it is considered that the flickering uncomfortable for 50% of people occurs and Pst value ≤1 is defined as a standard value by the IEC standards. The Plt value is obtained by root-mean-cube of 12 times (two hours) of measurement of the Pst value and Plt value ≤0.65 is defined as the standard value by the IEC standards. In the image forming device 1, it is required that the Pst value is not larger than one during the image forming operation and the Plt value is not larger than 0.65 at the time of standby, for example.

When the supply power to a large-capacity heater such as the first heater 186 of this embodiment formed of the halogen heater with the rated power of 1050 W is drastically increased from 0 W to maximum 1050 W or when this is drastically decreased from 1050 W to 0 W, for example, the flicker beyond the above-described standard value occurs.

For this, technology of inhibiting the fluctuation of the supply power by gradually increasing the supply power to the heater by the half-wave control to inhibit the flicker is conventionally known.

Figure 5A:
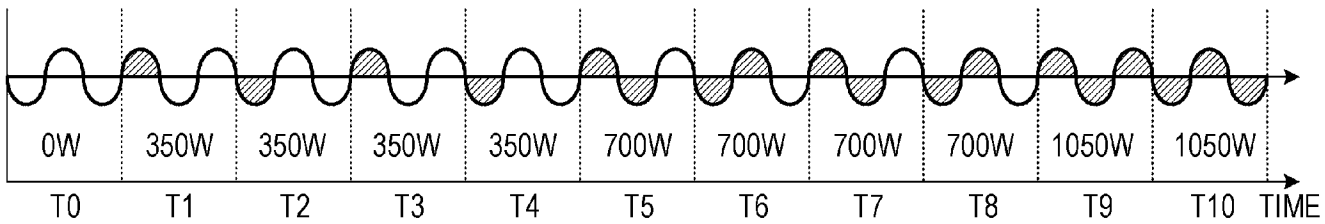
FIGS. 5A and 5B are views illustrating heating starting operation of the first heater by conventional half-wave control.
Figure 5B:
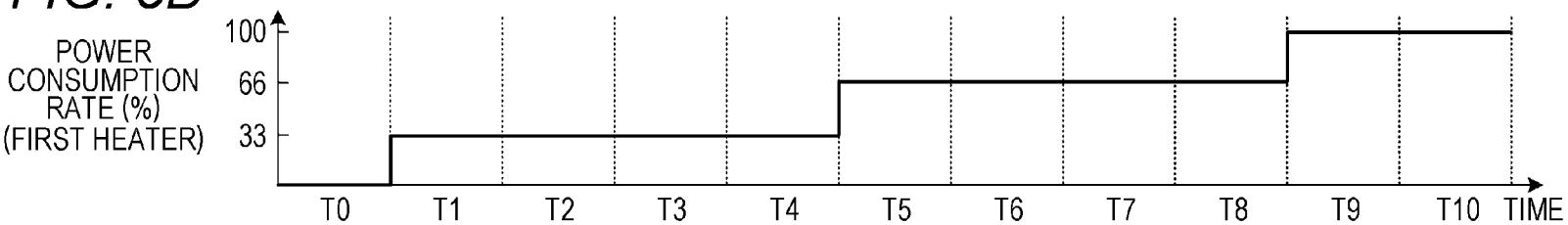

FIGS. 5A and 5B are views illustrating the heating starting operation of the first heater 186 by the conventional half-wave control.

In FIG. 5A, a part corresponding to the half wave in which the voltage is applied to the first heater 186 out of three half waves is colored in each of periods T0 to T10 having predetermined length. For example, in each of the periods T1 to T4, the voltage is applied in the period corresponding to one half wave for every three half waves, so that a duty ratio of a voltage applying period is 1/3. Similarly, the duty ratio in the periods T5 to T8 is 2/3, and the duty ratio in the periods T9 and T10 is one. FIG. 5B illustrates a power consumption rate in each of the periods T0 to T10 when the rated power is set to 100%; this is 0% in the period T0, 33% in the periods T1 to T4, 67% in the periods T5 to T9, and 100% in the periods T9 and T10. As a result, as illustrated in FIG. 5A, the power consumption of the first heater 186 in the conventional example steps up by 350 W such as 0 W, 350 W, 700 W, and 1050 W from the period T0 to the period T10.

In this embodiment, different from such conventional example, when heating operation by the first heater 186 is started, the power consumption of the first heater 186 is stepped up and the power consumption of the second heater 187 is stepped down such that a change amount of a total value of the power consumption of the first and second heaters 186 and 187 is controlled.

Figure 6A:
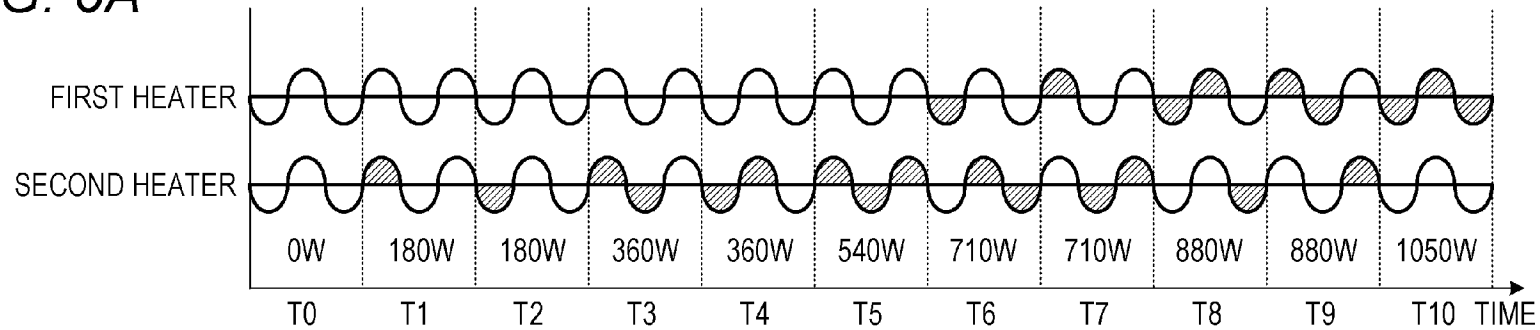
FIGS. 6A and 6B are views illustrating the heating starting operation of this embodiment.
Figure 6B:
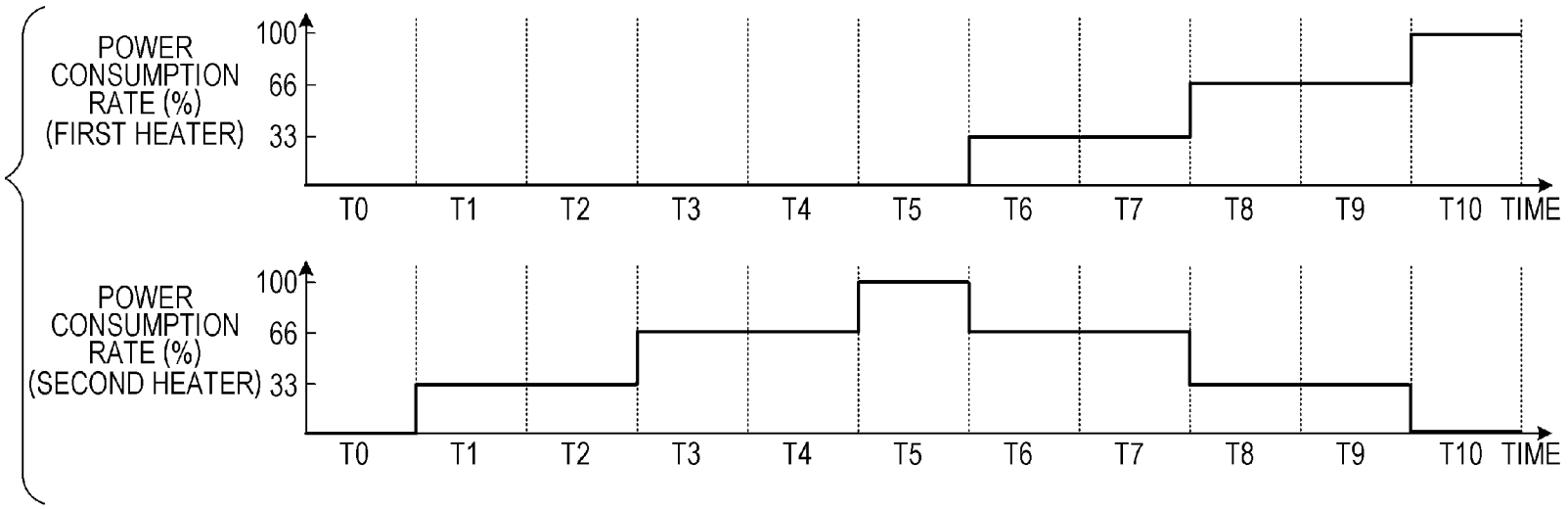

FIGS. 6A and 6B are views illustrating the heating starting operation of this embodiment. FIG. 6A is the view illustrating the aspect of the half-wave control and the power consumption in each of the periods T0 to T10 for the first and second heaters 186 and 187, and FIG. 6B is the view illustrating the power consumption rates of the first and second heaters 186 and 187 in each of the periods T0 to T10 when the rated power is set to 100%.

In the heating starting operation, as illustrated in FIG. 6B, the power consumption of the second heater 187 steps up from 0% to 100% over the periods T0 to T5 (preliminary control). Then, the power consumption of the second heater 187 steps down from 100% to 0% and the power consumption of the first heater 186 steps up from 0% to 100% over the periods T6 to T10 (energizing control).

In detail, as illustrated in FIG. 6A, the second heater 187 is operated at the duty ratio of 1/3 by the half-wave control in the periods T1 and T2, operated at the duty ratio of 2/3 in the periods T3 and T4, and operated at the duty ratio of 100% in the period T5. Subsequently, in the periods T6 and T7, the duty ratio of the second heater 187 is decreased to 2/3 and the first heater 186 is operated at the duty ratio of 1/3. In the periods T8 and T9, the duty ratio of the second heater 187 is decreased to 1/3 and the duty ratio of the first heater 186 is increased to 2/3. Then, in the period T10, the operation of the second heater 187 is stopped and the first heater 186 is operated at the duty ratio of 100%.

Meanwhile, the periods T0 to T10 may be set to have the same length and it is also possible that a part of or all the periods have different lengths. The length of each period is set to the length with which an excellent flicker value may be obtained within a range from several hundred milliseconds to several seconds, for example.

By controlling in this manner, it is possible to control an increase in the power consumption when it shifts from the period T5 to the period T6 to a value corresponding to difference between an increase in the power consumption of the first heater 186 and a decrease in the power consumption of the second heater 187. This also applies to the power consumption when it shifts from the period T7 to the period T8 and the power consumption when it shifts from the period T9 to the period T10.

As a result, as illustrated in FIG. 6A, the total value of the power consumption of the first and second heaters 186 and 187 steps up by 170 W such as 540 W, 710 W, 880 W, and 1050 W over the periods T5 to T10. In the periods T0 to T5 also, the power consumption steps up by 180 W such as 0 W, 180 W, 360 W, and 540 W by stepping up the power consumption of the second heater 187 by the half-wave control.

The power consumption of the first and second heaters 186 and 187 in the periods T6 to T10 in FIG. 6A is set such that the change amount when the power consumption of the first and second heaters 186 and 187 changes becomes a value which makes the flicker value (Pst value and/or Plt value) not larger than a predetermined standard value. The power consumption of the second heater 187 in the periods T1 to T5 in FIG. 6A is set such that the change amount when the power consumption of the second heater 187 changes becomes the value which makes the flicker value not larger than a predetermined standard value.

Meanwhile, the second heater 187 may be operated again after the period T10.

Figure 7:
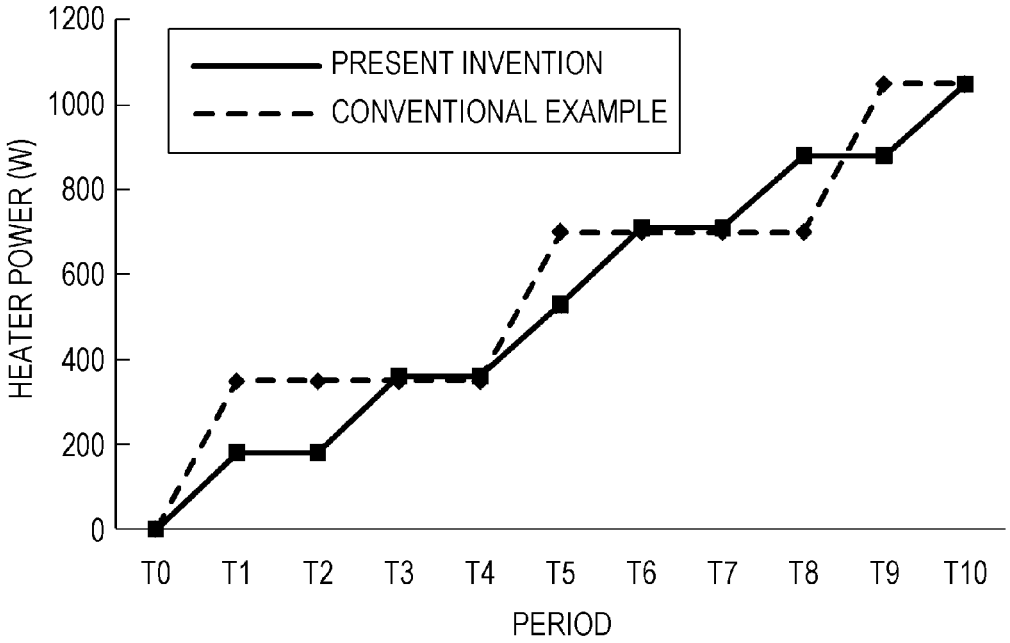
FIG. 7 is a view illustrating change in power consumption in each period in the heating starting operation of this embodiment and the conventional example.

FIG. 7 is a view illustrating the change in the power consumption in each of the periods T0 to T10 in the heating starting operation in this embodiment and the conventional example.

In FIG. 7, a solid line graph indicates the change in the total value of the power consumption of the first and second heaters 186 and 187 in the heating starting operation of this embodiment illustrated in FIGS. 6A and 6B and a broken line graph indicates the change in the power consumption of the first heater 186 in the conventional heating starting operation illustrated in FIGS. 5A and 5B. According to the heating starting operation of this embodiment, as indicated by the solid line graph, the change amount of the power consumption when the power consumption is increased is made smaller than that in the conventional heating starting operation (broken line graph). As a result, generation of inrush current to the first and second heaters 186 and 187 is inhibited and fluctuation of the voltage of the AC power supply 31 is inhibited. According to this, the occurrence of the flicker is inhibited.

Specifically, when the heating operation by the first heater 186 is started by the half-wave control in the conventional example illustrated in FIGS. 5A and 5B and the Plt value is measured, it takes 0.71 larger than the standard value (0.65) and the flicker beyond the standard occurs. In this manner, the heater with the large rated power has a problem that the flicker cannot be sufficiently inhibited even when the power consumption is stepped up by simple half-wave control.

On the other hand, when the heating starting operation according to this embodiment illustrated in FIGS. 6A and 6B is performed and the Plt value is measured, it takes 0.41 smaller than the standard value (0.65), so that it is confirmed that the effect of inhibiting the occurrence of the flicker is obtained. According to the heating starting operation of this embodiment, it is confirmed that the heating roller 182 is heated to desired temperature in shorter time than in a case in which the flicker is inhibited by slight step-up of the power consumption by phase control only by the first heater 186.

Figure 8A:
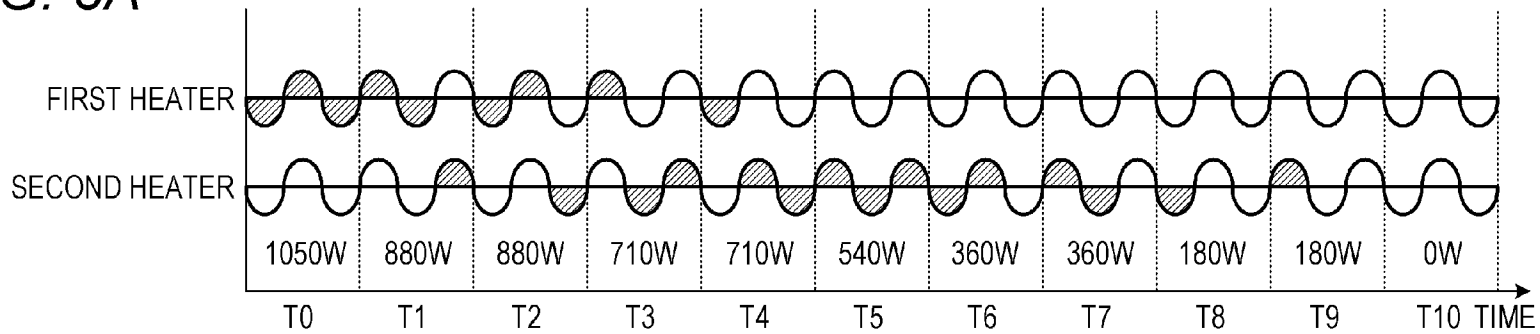
FIGS. 8A and 8B are views illustrating heating finishing operation of this embodiment.
Figure 8B:
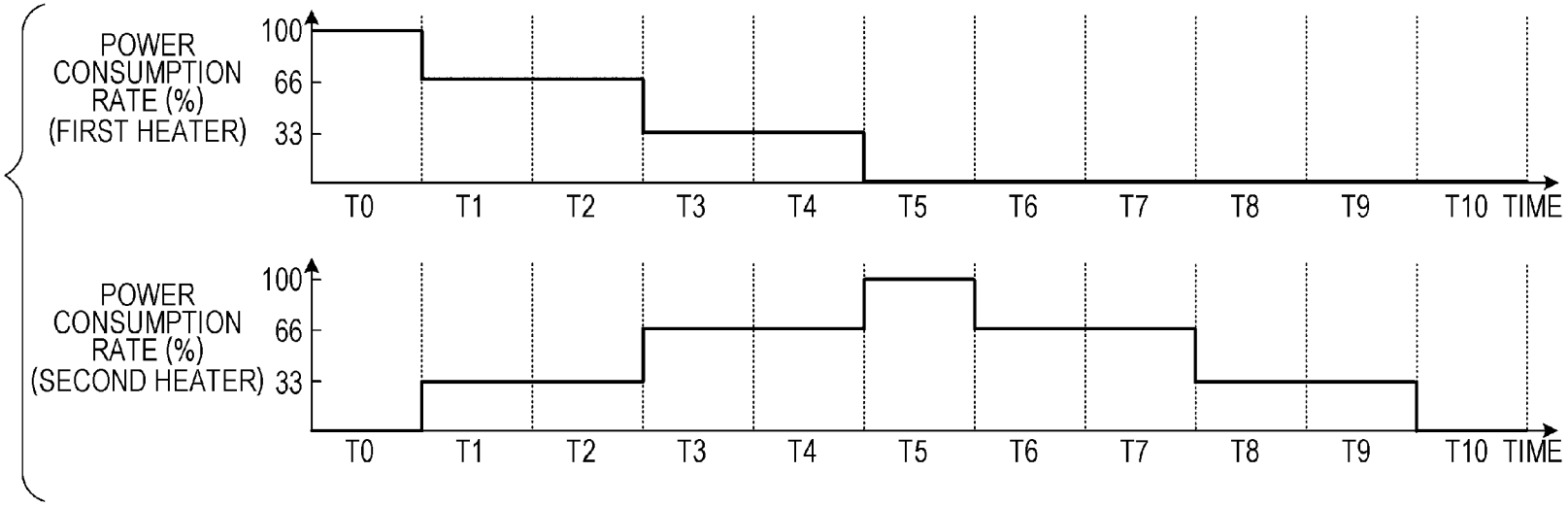

FIGS. 8A and 8B are views illustrating the heating finishing operation of this embodiment.

The heating finishing operation corresponds to the heating starting operation illustrated in FIGS. 6A and 6B proceeded in the opposite direction. That is to say, as illustrated in FIG. 8B, the power consumption of the first heater 186 steps down from 100% to 0% over the periods T0 to T5 and the power consumption of the second heater 187 steps up from 0% to 100% (energizing control). Then, the power consumption of the second heater 187 steps down from 100% to 0% over the periods T6 to T10 and the operation of the first and second heaters 186 and 187 stops.

In detail, as illustrated in FIG. 8A, the first heater 186 is operated at the duty ratio of 100% and the operation of the second heater 187 stops in the period T0. In the subsequent periods T1 and T2, the duty ratio of the first heater 186 is decreased to 2/3 and the second heater 187 is operated at the duty ratio of 1/3 by the half-wave control, and in the periods T3 and T4, the duty ratio of the first heater 186 is decreased to 1/3 and the duty ratio of the second heater 187 is increased to 2/3. Then, in the period T5, the operation of the first heater 186 is stopped and the second heater 187 is operated at the duty ratio of 100%. Thereafter, the duty ratio of the second heater 187 is decreased to 2/3 and 1/3 in the periods T6 and T7 and in the periods T8 and T9, respectively, and the operation of the second heater 187 stops in the period T10.

The power consumption of the first and second heaters 186 and 187 in the periods T1 to T5 in FIG. 8A is set such that the change amount when a sum of the power consumption of the first heater 186 and that of the second heater 187 changes becomes the value which makes the flicker value (Pst value and/or Plt value) not larger than a predetermined standard value. The power consumption of the second heater 187 in the periods T6 to T10 in FIG. 8A is set such that the change amount when the power consumption of the second heater 187 changes becomes the value which makes the flicker value not larger than a predetermined standard value.

Figure 9:
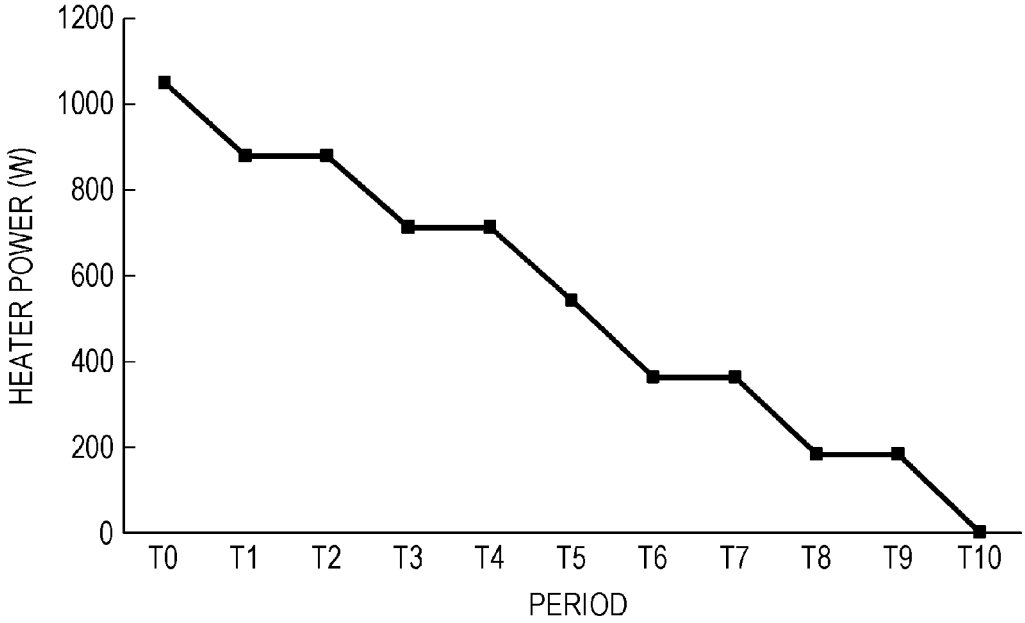
FIG. 9 is a view illustrating change in the power consumption in each period in the heating finishing operation of this embodiment.

FIG. 9 is a view illustrating the change in the power consumption in each of the periods T0 to T10 in the heating finishing operation of this embodiment.

A graph illustrated in FIG. 9 corresponds to that obtained by horizontally flipping the graph regarding the heating starting operation of this embodiment indicated by a solid line in FIG. 7. Therefore, an absolute value of inclination of the graph in FIG. 9 is the same as that of the solid line graph in FIG. 7. Therefore, in the heating finishing operation of this embodiment, as in the heating starting operation, the change amount of the power consumption when the power consumption is decreased is controlled to be smaller and the fluctuation in the voltage of the AC power supply 31 and the occurrence of the flicker caused by the inrush current to the first and second heaters 186 and 187 are inhibited. According to the heating starting operation of this embodiment, it is confirmed that the temperature of the heating roller 182 decreases in shorter time than in a case in which the flicker is inhibited by slight step-down of the power consumption by the phase control only by the first heater 186.

Next, a control procedure by the controller 10 when a heating starting process regarding the above-described heating starting operation and a heating finishing process regarding the heating finishing operation are executed is described.

Figure 10:
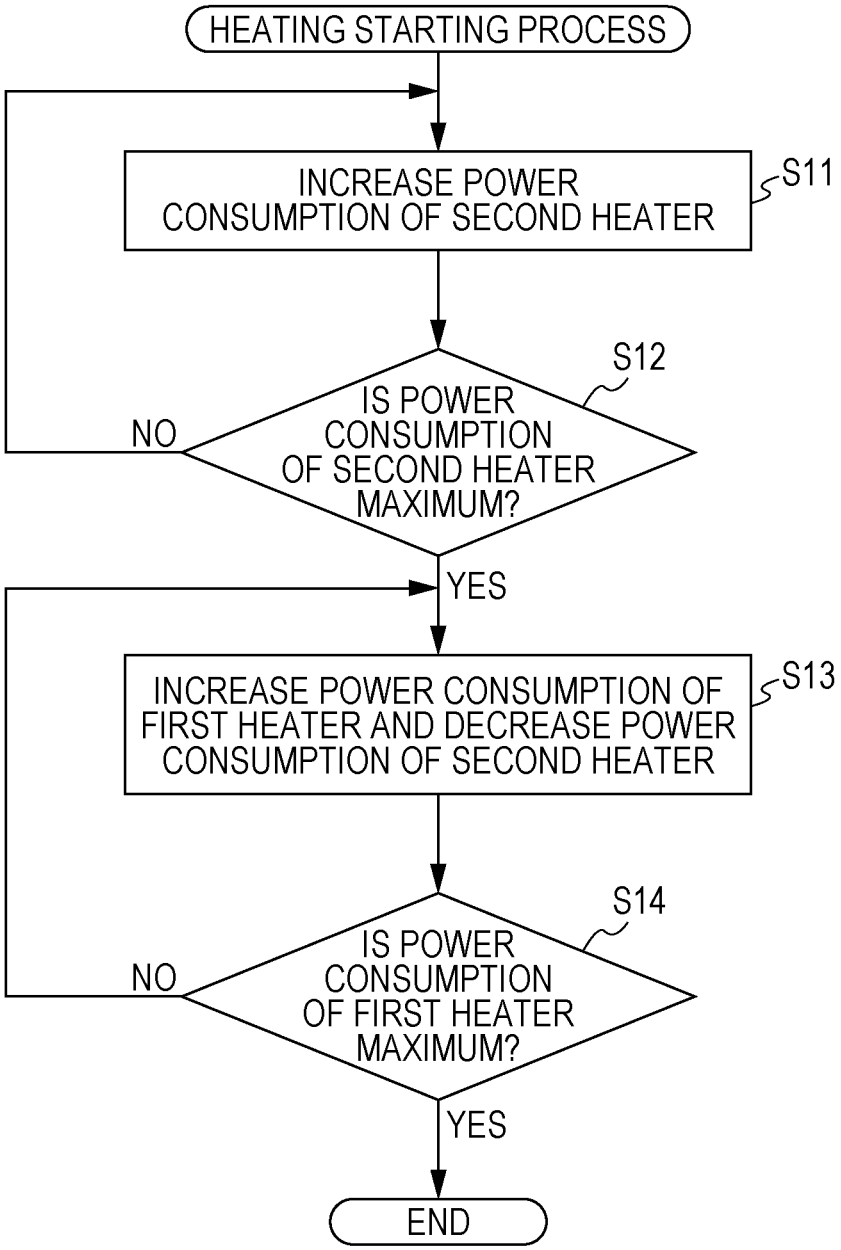
FIG. 10 is a flowchart illustrating a control procedure of a heating starting process.

FIG. 10 is a flowchart illustrating the control procedure of the heating starting process.

The heating starting process is executed when the operation of the first heater 186 stops and the temperature indicated by measurement data of the temperature sensor 185 is lower than lowest temperature at which the fixing by the image fixing unit 18 may be performed in a case in which the image forming operation by the image forming device 1 is performed.

When the heating starting process is started, the controller 10 increases the power consumption of the second heater 187 (step S11). That is to say, the controller 10 increases the duty ratio of a power supplying period of the second heater 187 by one half wave by wave number control.

The controller 10 determines whether the power consumption of the second heater 187 reaches a maximum value when predetermined time (for example, time corresponding to one period in FIGS. 6A and 6B) elapses after the process at step S11 finishes (step S12). When it is determined that the power consumption of the second heater 187 does not reach the maximum value (No at step S12), the controller 10 shifts the procedure to step S11.

When it is determined that the power consumption of the second heater 187 reaches the maximum value (Yes at step S12), the controller 10 increases the power consumption of the first heater 186 and decreases the power consumption of the second heater 187 (step S13). That is to say, the controller 10 increases the duty ratio of the power supplying period of the first heater 186 by one half wave and decreases the duty ratio of the power supplying period of the second heater 187 by one half wave by the wave number control.

The controller 10 determines whether the power consumption of the first heater 186 reaches the maximum value when the above-described predetermined time elapses after the process at step S13 finishes (step S14). When it is determined that the power consumption of the first heater 186 does not reach the maximum value (No at step S14), the controller 10 shifts the procedure to step S13. When it is determined that the power consumption of the first heater 186 reaches the maximum value (Yes at step S14), the controller 10 finishes the heating starting process.

Figure 11:
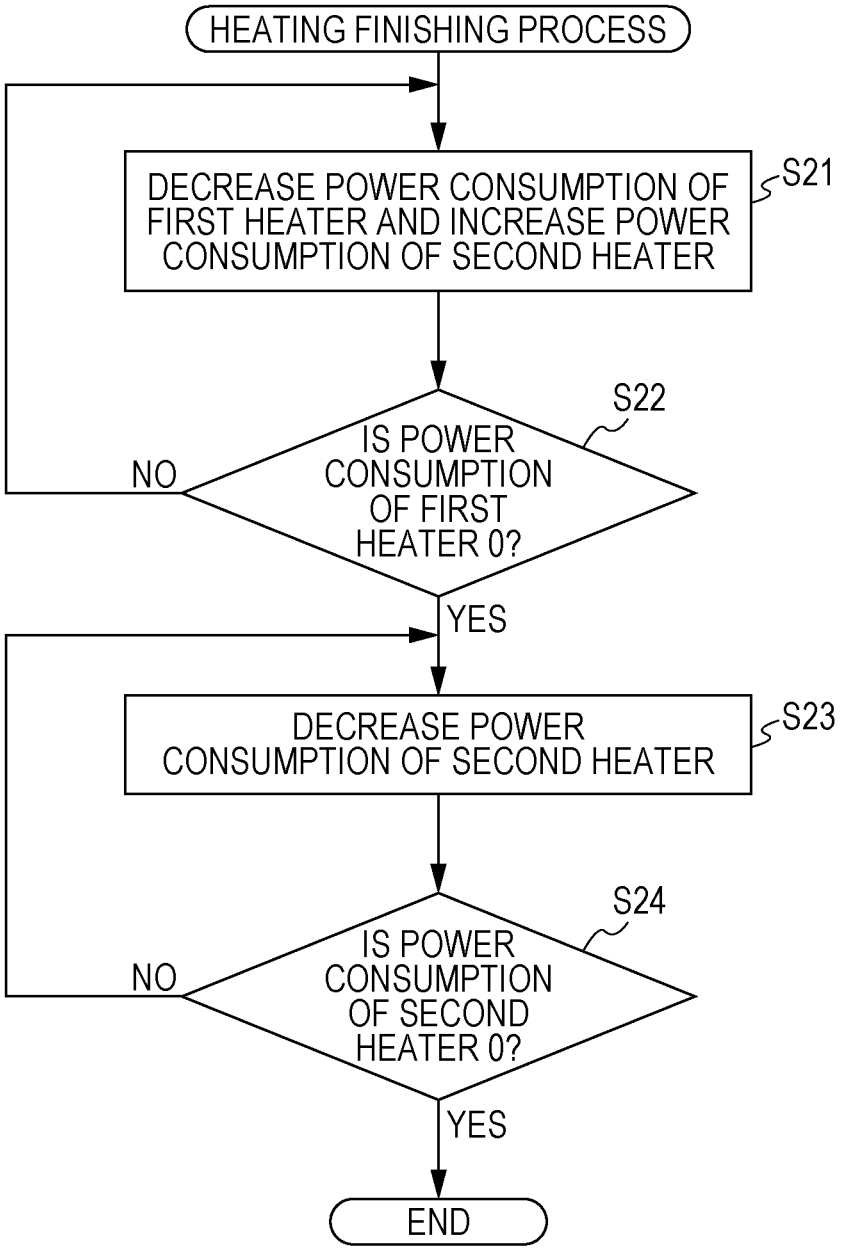
FIG. 11 is a flowchart illustrating a control procedure of a heating finishing process.

FIG. 11 is a flowchart illustrating a control procedure of the heating finishing process.

The heating finishing process is executed when the image forming operation by the image forming device 1 is stopped or when the temperature indicated by the measurement data of the temperature sensor 185 is higher than highest temperature at which appropriate fixing by the image fixing unit 18 may be performed during the image forming operation in a case in which the first heater 186 operates.

When the heating finishing process is started, the controller 10 decreases the power consumption of the first heater 186 and increases the power consumption of the second heater 187 (step S21). That is to say, the controller 10 decreases the duty ratio of the power supplying period of the first heater 186 by one half wave and increases the duty ratio of the power supplying period of the second heater 187 by one half wave by the wave number control.

The controller 10 determines whether the power consumption of the first heater 186 is 0 W when the above-described predetermined time elapses after the process at step S21 finishes (step S22). When it is determined that the power consumption of the first heater 186 is larger than 0 W (No at step S22), the controller 10 shifts the procedure to step S21.

When it is determined that the power consumption of the first heater 186 is 0 W (Yes at step S22), the controller 10 decreases the power consumption of the second heater 187 (step S23). That is to say, the controller 10 decreases the duty ratio of the power supplying period of the second heater 187 by one half wave by the wave number control.

The controller 10 determines whether the power consumption of the second heater 187 is 0 W when the above-described predetermined time elapses after the process at step S23 finishes (step S24). When it is determined that the power consumption of the second heater 187 is larger than 0 W (No at step S24), the controller 10 shifts the procedure to step S23. When it is determined that the power consumption of the second heater 187 is 0 W (Yes at step S24), the controller 10 finishes the heating finishing process.

Meanwhile, although the example of changing the process based on a determination result of the power consumption of the first heater 186 or the second heater 187 by the controller 10 at steps S12, S14, S22, and S24 is described above, there is no intention of limiting, and the controller 10 may also perform the processes regarding steps S11, S13, S21, and S23 according to an operational sequence determined in advance.

As described above, the fixing device according to this embodiment is provided with the fixing unit which heats the paper to fix the toner adhered to the paper (fixing belt 181, upper pressurizing roller 183, and lower pressurizing roller 184), the first heater 186 which heats the fixing unit, the second heater 187 with the rated power smaller than that of the first heater 186 which heats the fixing unit, and the controller 10 which performs the preliminary control of energizing the second heater 187 when the heating of the fixing unit by the first heater 186 is started and the energizing control of stepping up the power consumption of the first heater 186 and stepping down the power consumption of the second heater 187 such that the change amount when the sum of the power consumption of the first heater 186 and that of the second heater 187 changes becomes the value to make the flicker value indicating the degree of the flicker not larger than a predetermined standard value after executing the preliminary control. According to this, a part of the increase in the power consumption of the first heater 186 is balanced out by the decrease in the power consumption of the second heater 187 and the change amount of the sum of the power consumption of the first heater 186 and that of the second heater 187 is controlled to be smaller in the above-described energizing control, so that it is possible to rapidly increase the temperature of the fixing unit while inhibiting the fluctuation of the power supply voltage and the occurrence of the flicker caused by the inrush current to the first heater 186 at the time of the heating starting operation regardless of the rated power of the first heater 186.

The controller 10 steps up the power consumption of the second heater 187 such that the change amount when the power consumption of the second heater 187 changes becomes the value to make the flicker value indicating the degree of the flicker not larger than a predetermined standard value in the preliminary control. According to this, it becomes possible to inhibit the fluctuation of the power supply voltage and the occurrence of the flicker caused by the inrush current to the second heater 187 in the preliminary control.

The fixing device of this embodiment is provided with the fixing unit which heats the paper to fix the toner adhered to the paper (fixing belt 181, upper pressurizing roller 183, and lower pressurizing roller 184), the first heater 186 which heats the fixing unit, the second heater 187 with the rated power smaller than that of the first heater 186 which heats the fixing unit, and the controller 10 which performs the energizing control of stepping down the power consumption of the first heater 186 and stepping up the power consumption of the second heater 187 such that the change amount when the sum of the power consumption of the first heater 186 and that of the second heater 187 changes becomes the value to make the flicker value indicating the degree of the flicker not larger than a predetermined standard value when the heating of the fixing unit by the first heater 186 is finished. According to this, a part of the decrease in the power consumption of the first heater 186 is balanced out by the increase in the power consumption of the second heater 187 and the change amount when the sum of the power consumption of the first heater 186 and that of the second heater 187 changes is controlled to be smaller, so that it is possible to rapidly decrease the temperature of the fixing unit while inhibiting the fluctuation of the power supply voltage and the occurrence of the flicker caused by the inrush current to the first heater 186 at the time of the heating finishing operation regardless of the rated power of the first heater 186.

The controller 10 steps down the power consumption of the second heater 187 such that the change amount when the power consumption of the second heater 187 changes becomes the value to make the flicker value indicating the degree of the flicker not larger than a predetermined standard value after performing the energizing control. According to this, it is possible to inhibit the fluctuation of the power supply voltage and the occurrence of the flicker caused by the inrush current to the second heater 187 when the energization to the second heater 187 is stopped after the above-described energizing control.

The controller 10 changes the duty ratio of the period in which the voltage waveform is applied to each of the first and second heaters 186 and 187 in units of half cycle of the voltage waveform of the AC power supply in the energizing control. According to this, the control regarding the step-up and step-down of the power consumption of the first and second heaters 186 and 187 may be easily performed.

The flicker value is the short-time flicker value the standard value of which is one. According to this, it is possible to inhibit the flicker such that the short-time flicker value (Pst value) becomes not larger than the standard value defined by the IEC standards.

The flicker value is the long-time flicker value the standard value of which is 0.65. According to this, it is possible to inhibit the flicker such that the long-time flicker value (Plt value) becomes not larger than the standard value defined by the IEC standards.

The first heater 186 is the halogen heater. According to such configuration, it is possible to effectively inhibit the fluctuation of the power supply voltage and the occurrence of the flicker caused by the inrush current to the first heater 186 in a configuration in which the inrush current easily occurs when the heating of the first heater 186 is started.

The image forming device according to this embodiment is provided with the image forming unit 17 which allows the toner to adhere to the paper to record the image and the above-described fixing device. According to such configuration, it is possible to inhibit the fluctuation of the voltage of the power supply connected to the image forming device and the occurrence of the flicker regardless of the rated power of the first heater 186.

<Variation>

Next, a variation of the above-described embodiment is described.

In this variation, a duty ratio of a power supplying period of first and second heaters 186 and 187 is changed by phase control. Other points are similar to those of the above-described embodiment, so that difference from the above-described embodiment is hereinafter described.

In this variation, a CPU 101 controls supply power to the first heater 186 (second heater 187) by the phase control by using a driving circuit illustrated in FIG. 4. That is to say, the CPU 101 outputs an on-signal to turn the heater on to a gate of a transistor 341 (transistor 342) through an I/O 351 (I/O 352) at timing at which a predetermined period elapses from timing at which a zero crossing point is input from a zero crossing detecting circuit 36 through an I/O 353 (that is to say, when a voltage waveform of an AC power supply 31 reaches a predetermined phase). According to this, a controller 10 including the CPU 101 controls the supply power to the first heater 186 (second heater 187) by changing a ratio of a period in which voltage is applied in each half wave included in the voltage waveform of an AC power supply 31.

Figure 12:
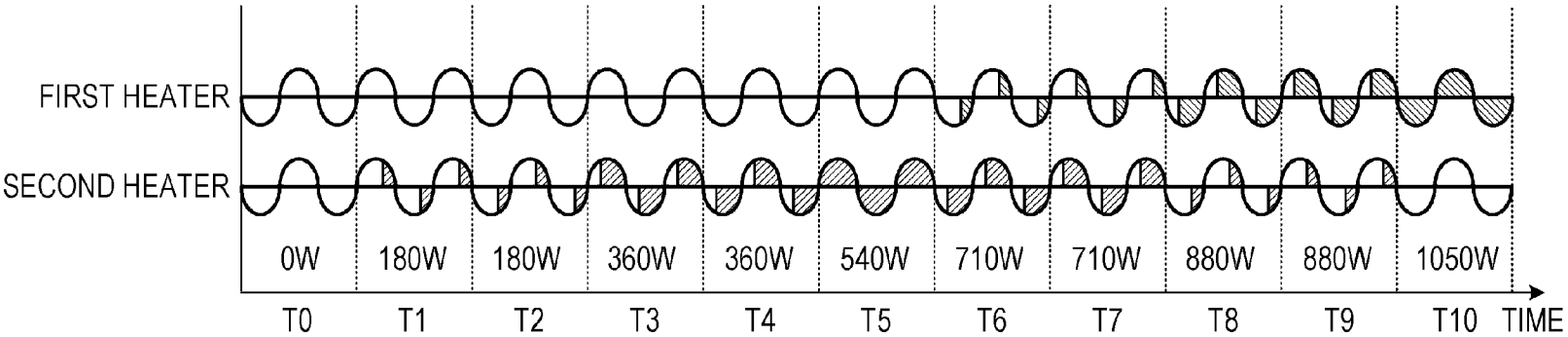
FIG. 12 is a view illustrating heating starting operation according to a variation.

FIG. 12 is a view illustrating heating starting operation according to the variation.

In FIG. 12, the period in which the voltage is applied in each half wave of the voltage waveform is colored. In this manner, in this variation, the duty ratio of the voltage applying period in each period to the first and second heaters 186 and 187 is controlled by the phase control. Power consumption of the first and second heaters 186 and 187 in each period is similar to that of the above-described embodiment.

In heating finishing operation similarly, the duty ratio of the power supplying period in each period is controlled by the phase control.

In this manner, in a fixing device according to this variation, the controller 10 changes the duty ratio of the period in which the voltage waveform is applied to each of the first and second heaters 186 and 187 by changing the ratio of the applying period of the voltage waveform in each half cycle of the voltage waveform of the AC power supply in energizing control. According to this, control regarding step-up and step-down of the power consumption of the first and second heaters 186 and 187 may be easily performed and an amount of the step-up and the step-down of the power consumption may be arbitrarily set.

Meanwhile, the present invention is not limited to the above-described embodiment and variation; this may be variously changed.

For example, although the configuration in which the first heater 186 is provided in the heating roller 182 and the second heater 187 is provided in the lower pressurizing roller 184 is described as an example in the above-described embodiment and variation, there is no intention of limiting. For example, it is also possible to provide separate heaters on the center and in the vicinity of both ends in the rotary axis direction of the heating roller 182 and make any one of them the first heater and make another one the second heater.

It is also possible to configure such that the fixing nip between the roller pair formed of the heating roller and the pressurizing roller holds the paper P to heat and pressurize the paper P and provide the first heater on one of the heating roller and the pressurizing roller and provide the second heater on the other of them.

In addition to the examples, it is also possible to make anyone of two or more heaters provided in the image fixing unit 18 for heating the fixing unit which holds and pressurizes the paper P to pressurize the first heater and make another heater with the rated power smaller than that of the first heater the second heater. The first heater may be formed of a plurality of heaters and the second heater may be formed of a plurality of heaters.

Although the example in which the power consumption of the first and second heaters 186 and 187 is changed in four stages is described in the above-described embodiment and variation, there is no intention of limiting and this may also be changed in three stages or five or more stages.

It is also possible to perform the half-wave control in units of two or four or more half waves in place of the aspect in which this is performed in units of three half waves.

Although the example in which the control of stepping up the power consumption of the second heater 187 is first performed in the heating starting operation is described in the above-described embodiment and variation, there is no intention of limiting. When the rated power of the second heater 187 is small and the flicker beyond the standard value does not occur even when the power consumption is increased at once, it is also possible to omit the control of stepping up the power consumption of the second heater 187 and increase the power consumption to the value in the period T5 in FIG. 6A at once.

Similarly, it is also possible to omit the control of stepping down the power consumption of the second heater 187 in the heating finishing operation and decrease the power consumption from the value in the period T5 in FIG. 8A to 0 W at once.

Although the example in which the power supply to the first heater 186 is started after the power consumption rate of the second heater 187 reaches 100% in the heating starting operation is described in the above-described embodiment and variation, it is also possible to perform the operation after the period T6 in FIGS. 6A and 6B to start the power supply to the first heater 186 before the power consumption rate of the second heater 187 reaches 100%.

Similarly, in the heating finishing operation in FIGS. 8A and 8B, in place of the aspect in which the power consumption rate of the second heater 187 is increased from 0% to 100% over the periods T0 to T5, the aspect in which this is increased up to a predetermined power consumption rate smaller than 100% is also possible.

Although the Pst value (not larger than one) and the Plt value (not larger than 0.65) are described as an example of the standard value of the flicker in the above-described embodiment and variation, the standard value other than them may also be used. As another standard value of the flicker, there is a flicker rate ΔV10 obtained by multiplying luminous coefficient by a voltage drop rate ΔV % indicating magnitude of voltage drop. The standard value of the flicker rate ΔV10 is appropriately set within a range from 0.23 to 0.45, for example.

Although the example in which the paper is used as the recording medium is described in the above-described embodiment and variation, various media with which the color material adhered to the surface thereof may be fixed such as cloth or sheet-shaped resin may be used in addition to the paper such as plain paper and coated paper as the recording medium.

Although some embodiments of the present invention are described, the scope of the present invention is not limited to the above-described embodiments but includes the scope of the invention recited in claims and the equivalent thereof.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A fixing device configured to draw power from an alternating current power supply, the fixing device comprising:

a fixing unit configured to heat a recording medium to fix a color material adhered to the recording medium;

a first heater configured to heat the fixing unit;

a second heater with a second rated power smaller than a first rated power of the first heater, the second heater being configured to heat the fixing unit; and a controller configured to perform preliminary control to set a flicker value of the alternating current power supply equal to or smaller than a predetermined value, by starting heating of the fixing unit by the first heater when the second heater is energized, and thereafter performing energizing control of gradually stepping up a power consumption of the first heater in a plurality of steps while gradually stepping down a power consumption of the second heater in a plurality of steps, wherein the power consumption of the first heater and the power consumption of the second heater are independently controlled by changing a duty ratio of a period in which a voltage waveform is applied to each of the first and second heaters.

2. The fixing device according to claim 1, wherein the controller is configured to change a duty ratio of a period in which a voltage waveform is applied to each of the first and second heaters in units of half cycle of the voltage waveform of the alternating current power supply in the energizing control.

3. The fixing device according to claim 1, wherein the controller is configured to change a duty ratio of a period in which a voltage waveform is applied to each of the first and second heaters by changing a ratio of an applying period of the voltage waveform in each half cycle of the voltage waveform of the alternating current power supply in the energizing control.

4. The fixing device according to claim 1, wherein the flicker value is a short-time flicker value and the predetermined value is one.

5. The fixing device according to claim 1, wherein the flicker value is a long-time flicker value and the predetermined value is 0.65.

6. The fixing device according to claim 1, wherein the first heater is a halogen heater.

7. An image forming device comprising:

an image forming unit configured to adhere a color material to a recording medium to record an image; and the fixing device according to claim 1.

8. A fixing device configured to draw power from an alternating current power supply, the fixing device comprising:

a fixing unit configured to heat a recording medium to fix a color material adhered to the recording medium;

a first heater configured to heat the fixing unit;

a second heater with a second rated power smaller than a first rated power of the first heater, the second heater being configured to heat the fixing unit; and a controller configured to perform energizing control to set a flicker value of the alternating current power supply equal to or smaller than a predetermined value, by gradually stepping down a power consumption of the first heater in a plurality of steps while gradually stepping up a power consumption of the second heater in a plurality of steps, wherein the power consumption of the first heater and the power consumption of the second heater are independently controlled by changing a duty ratio of a period in which a voltage waveform is applied to each of the first and second heaters.

9. The fixing device according to claim 8, wherein the controller is configured to change a duty ratio of a period in which a voltage waveform is applied to each of the first and second heaters in units of half cycle of the voltage waveform of the alternating current power supply in the energizing control.

10. The fixing device according to claim 8, wherein the controller is configured to change a duty ratio of a period in which a voltage waveform is applied to each of the first and second heaters by changing a ratio of an applying period of the voltage waveform in each half cycle of the voltage waveform of the alternating current power supply in the energizing control.

11. The fixing device according to claim 8, wherein the flicker value is a short-time flicker value and the predetermined value is one.

12. The fixing device according to claim 8, wherein the flicker value is a long-time flicker value and the predetermined value is 0.65.

13. The fixing device according to claim 8, wherein the first heater is a halogen heater.

14. An image forming device comprising:

an image forming unit configured to adhere a color material to a recording medium to record an image; and the fixing device according to claim 8.

* * * * *